US006224421B1

(12) United States Patent
Maturo, Jr.

(10) Patent No.: US 6,224,421 B1
(45) Date of Patent: May 1, 2001

(54) MULTI-PART CONNECTOR

(75) Inventor: John E. Maturo, Jr., Thomaston, CT (US)

(73) Assignee: Palco Connector, Inc., Naugatuck, CT (US)

( * ) Notice: Subject to any disclaimer, the term of this patent is extended or adjusted under 35 U.S.C. 154(b) by 0 days.

(21) Appl. No.: 09/516,442

(22) Filed: Feb. 29, 2000

(51) Int. Cl.[7] ..... H01R 9/05
(52) U.S. Cl. ..... 439/581; 439/247
(58) Field of Search ..... 439/63, 581, 74, 439/247, 248, 552, 126, 556, 559

(56) References Cited

U.S. PATENT DOCUMENTS

| | | | | |
|---|---|---|---|---|
| 4,358,174 | | 11/1982 | Dreyer . | |
| 4,360,244 | | 11/1982 | Forney, Jr. et al. . | |
| 4,426,127 | | 1/1984 | Kubota . | |
| 4,453,796 | | 6/1984 | Monroe . | |
| 4,580,862 | | 4/1986 | Johnson . | |
| 4,795,352 | | 1/1989 | Capp et al. . | |
| 4,815,986 | | 3/1989 | Dholoo . | |
| 4,861,271 | * | 8/1989 | Bogar et al. | 439/63 |
| 4,929,188 | | 5/1990 | Lionetto et al. . | |
| 4,941,836 | | 7/1990 | Bormuth . | |
| 5,011,415 | | 4/1991 | Suzuki et al. . | |
| 5,078,621 | | 1/1992 | Nishikawa et al. . | |
| 5,104,325 | | 4/1992 | Mitani et al. . | |
| 5,137,462 | * | 8/1992 | Casey et al. | 439/74 |
| 5,180,315 | | 1/1993 | Nagashima . | |
| 5,190,474 | | 3/1993 | Ginet . | |
| 5,322,453 | | 6/1994 | Resnick et al. . | |
| 5,329,262 | | 7/1994 | Fisher, Jr. . | |
| 5,516,303 | | 5/1996 | Yohn et al. . | |
| 5,516,307 | | 5/1996 | Cartesse et al. . | |
| 5,641,294 | * | 6/1997 | Beard | 439/247 |
| 5,879,190 | | 3/1999 | Maruyama et al. . | |
| 6,079,986 | * | 6/2000 | Beshears | 439/63 |

* cited by examiner

*Primary Examiner*—Neil Abrams
*Assistant Examiner*—J. F. Duverne
(74) *Attorney, Agent, or Firm*—DeLio & Peterson, LLC

(57) ABSTRACT

A multi-part electrical connector includes a base piece (10) that is mounted to an electrical circuit board (88), preferably by soldering, and a double ended connector piece (12) that is attached to the base piece. The base piece includes a mount (14) at one end and a base subconnector (16) at the other end. The base subconnector mates with a corresponding subconnector formed on one end (28) of the double ended connector piece, the other end (26) having the desired type of main connector. A resilient piece (42), preferably in the shape of an O-ring and positioned between the base piece (10) and the double ended connector piece (12), allows the main connector end (26) of the double ended connector piece (12) to move relative to the base piece (10) so that it self aligns as a corresponding main connector is mated.

20 Claims, 3 Drawing Sheets

MULTI-PART CONNECTOR

BACKGROUND OF THE INVENTION

1. Field of the Invention

This invention relates to electrical connectors. More specifically, this invention relates to electrical connectors, preferably coaxial electrical connectors that are rigidly mounted but need to move slightly relative to the mounting to achieve correct alignment with a corresponding mating connector. The invention also relates to sensitive coaxial electrical connectors that must be mounted to a circuit board or other type of electronic equipment, but which can be damaged during soldering or other processing steps that occur when the circuit board or equipment is manufactured.

2. Description of Related Art

Coaxial connectors are widely used to carry signals between different circuits in electronic devices and between different electronic modules in complex modularly designed equipment. In a common design, one member of a mating pair of coaxial connectors is soldered directly to a printed circuit board, carrying a first circuit, and the other member of the pair is attached to a length of coaxial cable. The coaxial cable is attached to a second circuit board, and the connectors are mated by hand. The flexibility of the coaxial cable avoids alignment problems between the two connectors or the circuit boards.

However, the cables needed for this type of design take more space than is desirable. As the number of connections to be made increases, it has become desirable to eliminate the cable and attach the two mating connectors directly to their respective circuit boards or electronic modules to permit direct connection between them.

One difficulty with directly mounting the connectors is that conventional connectors are rigid which results in alignment difficulties and undesirable stresses on the circuit boards and connectors. Mounting tolerances can add up to the point where proper connection is not possible. Even if the connectors can be mounted accurately to their respective circuit boards, it can be difficult to get the connectors to mate. Conventional single piece coaxial connectors that are rigidly soldered to a printed circuit board are not well suited to this type of application. The problem is compounded where the connectors are positioned at the back of a circuit board or piece of electronic equipment where they cannot be seen and must be mated blind.

A related problem is where multiple coaxial connectors are to be mounted near each other on a single circuit board. In this situation, it is desirable to place a housing around all the adjacent connectors and provide a corresponding mating housing around the mating connectors. This allows all the connectors to be mated at once. This design may be used even where the mating connectors are to be attached to flexible coaxial cable. However, minor positioning errors and tolerances can add up for the connectors that are rigidly mounted to the circuit board making it very difficult to engage all of the connectors in the mating housing.

To address these problems, self aligning coaxial connectors have been developed. One type of self aligning connector has one end that is rigidly soldered to the printed circuit (PC) board and another end that moves relative to the soldered end. U.S. Pat. No. 5,769,652 shows an example of this type of connector. The connector shown therein has a first piece that is rigidly mounted to the circuit board and a second piece that is captured by and floats relative to the first piece. The first piece is assembled to the second piece when the connector is manufactured. Electrically conductive springs or flexible members are used to electrically connect the two pieces together.

A difficulty with this type of connector is that the connector is installed fully assembled and is therefore exposed to all processing steps that the circuit board is subjected to, including heat, during the soldering step, and various solvents and chemicals during cleaning steps. Some coaxial connectors, particularly high performance connectors, can be damaged during conventional printed circuit board processing steps.

Another type of self-aligning connector is not attached rigidly to the circuit board or electronic module. Instead, the connector floats in an oversized opening in the PC board or module case with flanges on each side of the circuit board or case to retain it in the opening. This allows the connector to move within the opening so that it can easily align with a mating connector. U.S. Pat. Nos. 4,580,862 and 4,358,174 show examples of this type of connector. These connectors provide the desired self-alignment capability and they can be installed after the circuit board processing is complete, but they cannot be directly soldered to the circuit board, and therefore require additional soldering steps to install.

Bearing in mind the problems and deficiencies of the prior art, it is therefore an object of the present invention to provide an electrical connector that is rigidly mounted and yet moves sufficiently to align with a corresponding electrical connector.

Another object of the present invention is to provide an electrical connector that can be soldered to a circuit board during the normal circuit board soldering steps without risk of damaging the sensitive portions of the connector during the soldering or related manufacturing steps.

A further object of the present invention is to provide a connector that accommodates axial insertion distance errors, radial position alignment errors and angular alignment errors.

Yet another object of the present invention is to provide an electrical connector that has a first part that may be installed permanently during construction of a circuit and a second part that may be varied and installed after construction of the circuit to accommodate different types of mating connectors.

A further object of the present invention is to provide an electrical connector that may be installed in a shell or housing.

Still other objects and advantages of the invention will in part be obvious and will in part be apparent from the specification.

SUMMARY OF THE INVENTION

The above and other objects, which will be apparent to those skilled in art, are achieved in the present invention which is directed to a multi-part electrical connector connectable to a corresponding electrical connector. The multi-part electrical connector includes a base piece for connection to a connection point on an electrical circuit and a double ended connector piece.

The base piece includes a mounting end having a mount formed thereon and a subconnector end having a base subconnector formed thereon. The mount on the base piece is rigidly mountable and connectable to the connection point on the electrical circuit. The base subconnector allows the double ended connector piece to be attached to the base piece.

The double ended connector piece includes a subconnector end having a second subconnector formed thereon which is mateable to the base subconnector, and a main connector end having a main connector formed thereon. The main connector is mateable to the desired type of corresponding electrical connector.

The double ended connector piece is movable relative to the base piece to make the multi-part electrical connector self-aligning relative to the electrical connector that the main connector is designed to mate with. In one aspect of the invention, this relative motion is provided by a resilient member positioned between the base piece and the double ended connector piece. The resilient member may be a ring, such as an O-ring or a flattened washer shape.

In another aspect of the invention, the multi-part electrical connector is provided with a plurality of flanges for holding the multi-part electrical connector in a housing. The main connector on the double ended connector piece may be of any type and may be formed at an angle, such as a right angle, to the subconnector on the double ended connector piece. The main connector on the main connector end may be designed to be mateable to a constant impedance electrical connector. #

The separation of the base piece from the double ended piece allows the double ended piece and its main connector to be isolated from the processing steps, including soldering and exposure to heat and chemicals that might damage it. It also allows a mix-and-match system in which different types of connector base pieces, adapted for surface mount, lead mount or edge mount may be attached to different types of double ended pieces, such as right angle pieces, in-line pieces, pieces adapted for mounting into different types of housings and pieces having different types of main connectors.

The invention also includes the method of attaching a connector to an electrical connection point on an electrical circuit in which a separate base piece of the type described is positioned adjacent to the connection point on an electrical circuit. The base piece is then soldered to connect the mount on the base piece to the connection point on the electrical circuit. The double ended connector piece is then attached to the subconnector end of the base piece.

In another aspect of the method, a housing is attached to the connector after the double ended connector piece has been attached to the subconnector end of the base piece.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1–7 of the drawings in which like numerals refer to like features of the invention.

Figure 1:
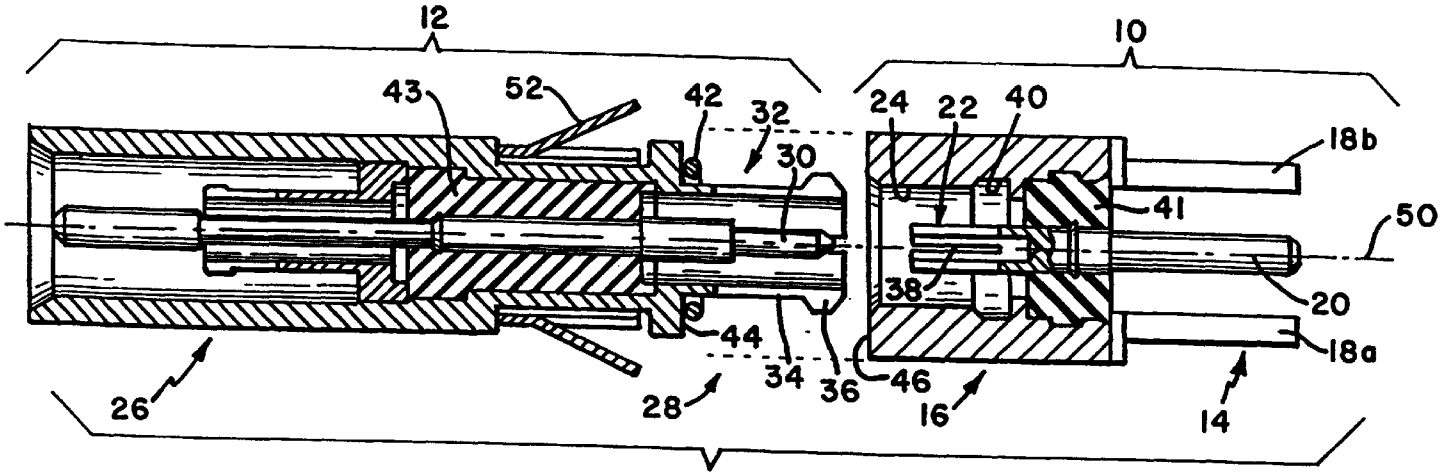
FIG. 1 is a cross-sectional view of a first embodiment of a self aligning multipart connector according to the present invention showing a socket or receptacle type main connector on the double ended piece which is separated from the base piece of the connector.

Referring to FIG. 1, the present invention includes a coaxial electrical connector formed as two separate pieces, including a base piece 10 and a double ended piece 12. The opposite ends of the base piece 10 comprise a mounting end 14 and a subconnector end 16. The mounting end 14 has a mount on it that is designed for rigid connection, typically by soldering, to a printed circuit board or other type of electrical circuit or electronic equipment.

Figure 2:
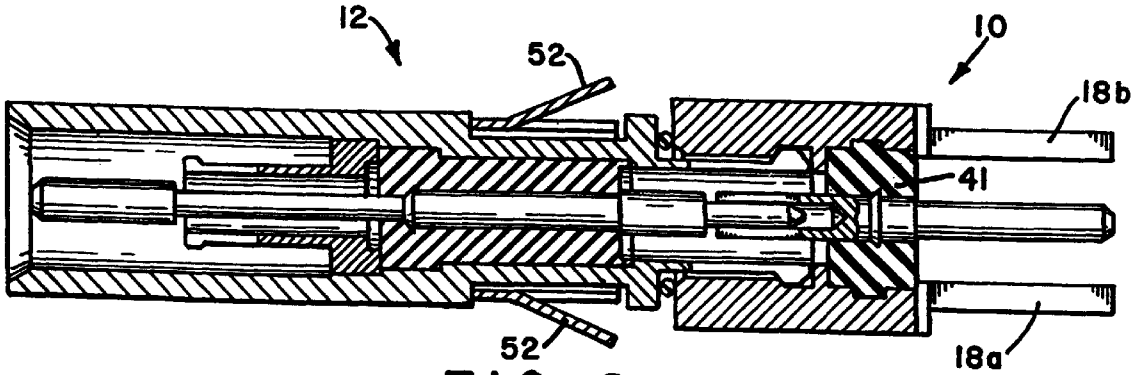
FIG. 2 is a cross-sectional view of the self-aligning multi-part connector shown in FIG. 1 showing the two pieces of the connector assembled.
Figure 3:
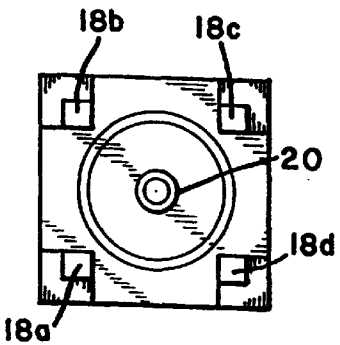
FIG. 3 is an elevational view taken from the right side of FIG. 2 looking axially towards the base piece of the connector seen in FIG. 2.

In the embodiment shown in FIGS. 1–3, the mount includes five leads for connection to a printed circuit board. The five leads include four outer conductor leads 18*a*–18*d* and a center conductor lead 20. The leads are soldered into correspondingly spaced openings in the printed circuit board in a conventional manner. The subconnector end 16 includes a socket type subconnector having a socket type inner conductor 22 and socket type outer conductor 24. The socket type outer conductor 24 connects to the four outer conductor leads 18*a*–18*d*. The socket type inner conductor 22 connects to the center conductor lead 20.

The double ended piece 12 includes a main connector end 26 and, at the opposite end, a subconnector end 28. As can be seen by comparing the disassembled connector in FIG. 1 to the assembled connector in FIG. 2, the subconnector end 28 on the double ended piece 12 has a plug type subconnector that mates with the socket type subconnector on the subconnector end 16 of the base piece 10.

More specifically, when the two subconnector ends are engaged, an inner conductor pin 30 on the subconnector end 28 of the double ended piece 12 enters the socket type inner conductor 22 on the base piece, and a plug type outer conductor 32 on the subconnector end 28 enters the socket type outer conductor 24 on the base piece. The outer conductor 32 is provided with axial slots 34. These slots allow the outer conductor to be compressed slightly so that the ridge 36 at the end of outer conductor 32 will fit into outer conductor 24 on the base piece.

Corresponding longitudinal slots 38 (see FIG. 1) on the inner conductor 22 allow the inner conductor 22 to be compressed slightly when the connector is constructed. The inner conductor 22 then expands slightly to receive and securely engage the pin end of inner conductor 30 when the two halves of the subconnector are engaged. When the subconnector end 28 of the double ended piece 12 is fully inserted into the subconnector end 16 of the base piece, the ridge 36 springs outward and engages inner ring 40 of the base piece. The dimensions of ridge 36 may be varied in combination with the shape of the ridge, the shape of the corresponding inner ring 40 and the compressibility of the outer conductor 32 so that the connection between the double ended piece 12 and the base piece 10 may be permanent, semi-permanent or removable, as desired.

The outer conductor 24 of the base piece is preferably made of brass. The outer conductor 32 of the double ended piece is preferably made of beryllium-copper. Generally, it is preferred that non-flexing pieces be made of brass and flexing pieces, such as flanges 52, be made of beryllium-copper.

The double ended piece 12 includes an optional resilient member 42, preferably made of silicone or conductive silicone. The resilient member 42 may be in the form of a resilient O-ring, flattened washer or gasket and it is compressed slightly between the lip 44 on the subconnector end 28 and the lip 46 on the subconnector end 16. The resilient member 42 exerts a slight outward pressure on the double ended piece 12, but has sufficient resiliency to allow the double ended piece 12 to rock angularly relative to the center line 50 of the base piece 10.

The rocking action between the base piece and the double ended piece allows the main connector end 26 to move relative to the base piece 10 when the base piece is securely soldered to a printed circuit board. This relative motion allows the tip of the main connector to move perpendicular to its axis, as needed during self-alignment of the main connector, and also serves to prevent the main connector on end 26 from applying excessive force to the base piece 10 which might damage the printed circuit board.

Figure 6:
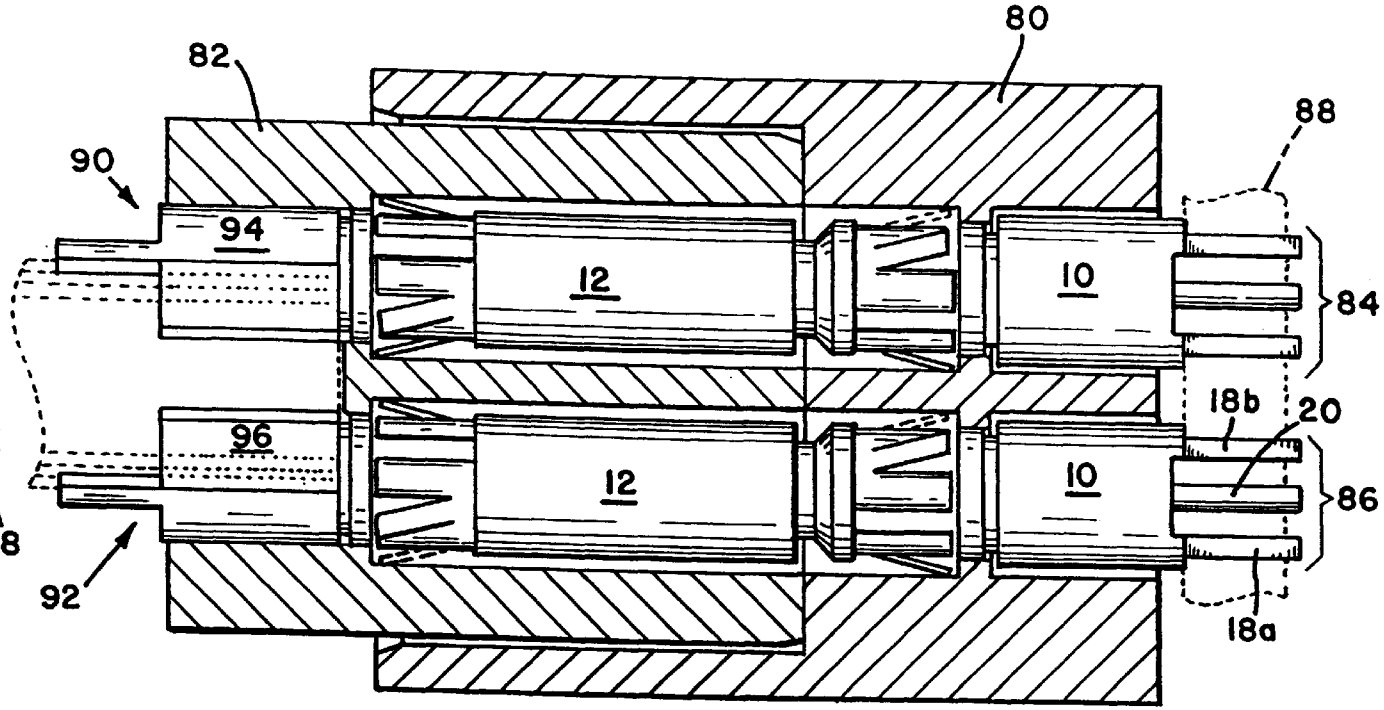
FIG. 6 is a partial cross-sectional view showing four self aligning multi-part connectors of two different types inserted into mating in-line male and female housings according to the present invention. The housings are shown in cross section, the connectors are not. The female housing on the right includes two inline plug type connectors having printed circuit board mount base pieces with leads of the type seen in FIG. 1 connected to double ended pieces with plug type main connectors. The male housing has two in-line socket type connectors having end launcher mounts suitable for connection to the edge of a printed circuit board. Printed circuit boards are shown in dashed lines.
Figure 7:
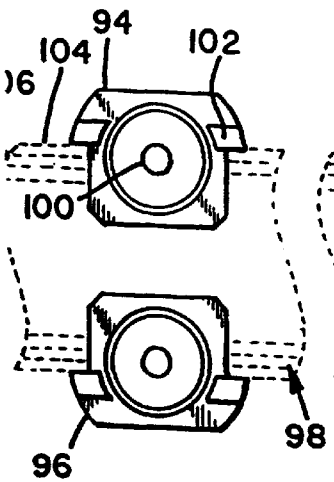
FIG. 7 is an end view from the right of FIG. 6 showing the end launcher base pieces only. The edge of a printed circuit board to which the end launcher base pieces are attached is shown in dashed lines.

The base piece 10 can be constructed with any type of desired mounting system for connection to printed circuit boards. Suitable mounts include end launcher mounts (as seen in FIGS. 6 and 7), surface mount connections, compliant pins, as well as conventional soldered leads. The flexibility of the inner conductor 22 and the outer conductor 32 on the subconnector ends, which is due in part to multiple longitudinal slots 34 and 38 on those conductors, permits the necessary rocking action and motion for the main connector end 26 so that it can self-align and engage a mating type of main connector.

The subconnector ends are shown with the female socket type subconnector on the base piece 10 and the male plug type subconnector on the double ended piece. However this arrangement may be reversed. The design of the subconnector may also be varied significantly, if desired, provided that continuous connection through the assembled connector is provided for each portion of the. main connector to the corresponding attachment point on the circuit board.

By varying the type of mount on the mounting end 14, the base piece can be attached to any desired type of circuit or circuit board, and different known methods of attachment of electronic components may be used to connect the base piece. After the circuit board is assembled, with the base piece rigidly mounted thereon, the double ended piece 12 may be attached to the base piece. The double ended piece may also have any desired type of main connector formed thereon.

Thus, in some embodiments of the invention, the base pieces may be mixed and matched with different types of double ended pieces so that different types of circuit board mounts are matched to different types of main connectors. This permits a more limited inventory of base pieces and double ended pieces to be used to construct different types of connectors. Alternatively, a single circuit board pre-assembled with base pieces attached may be configured and reconfigured in different ways for different types of housings that may require different main connectors, or different connector orientations, including right angle connectors or in-line connectors.

Another important advantage of this multi-part connector design is that the main connector does not have to be exposed to the extremes of normal circuit board construction including heat during soldering, particularly wave soldering operations, and chemicals during cleaning, etc. The base piece is constructed with a processing insensitive design capable of surviving during the processing steps and the main connector end 26 can be constructed with processing sensitive materials and techniques. The base piece is subjected to the processing of the circuit board which mounts it rigidly to the circuit board and the main connector end on the double ended piece may be attached later which avoids the rigors of these processing steps.

FIG. 2 shows the two separate pieces of the multi-part connector of FIG. 1 as they appear after they are assembled into a single connector. The connector may be used as a stand alone connector, but it may also be mounted into a housing with other connectors. Housing flanges 52 are provided to hold the double ended portion 12 of the connector in a corresponding housing. The main connector end 26 is shown with a constant impedance main connector of the type shown in U.S. Pat. No. 4,917,630, but any desired type of connector may be used including both coaxial and non-coaxial main connector ends.

Figure 4:
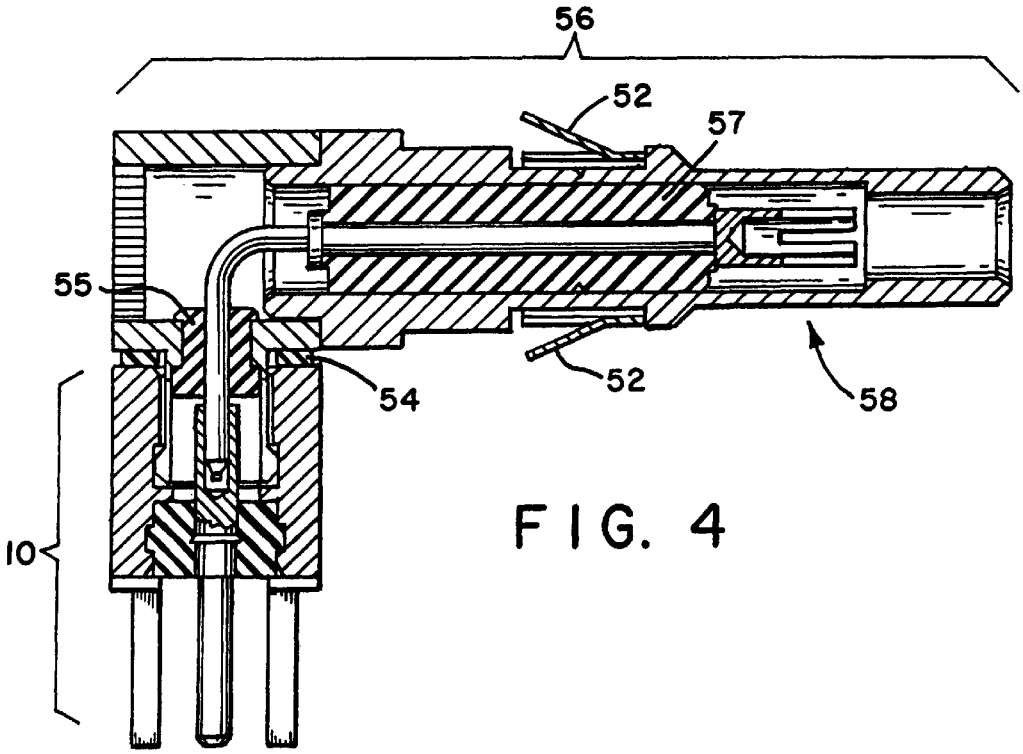
FIG. 4 is a cross-sectional view of a second embodiment of a self aligning multi-part connector according to the present invention showing a right angle version of the double ended piece having a plug type main connector. The double ended piece and the base piece are shown assembled.

A particular advantage of using the constant impedance main connector of the type shown in U.S. Pat. No. 4,917,630 is that this type of main connector operates correctly even when the mating connector (an example of which is shown in FIG. 4) is not fully seated axially. The present invention provides self-alignment motion of the connector in the radial plane perpendicular to the axis due to the rocking action between the fixed base piece and the double ended piece. This self-alignment motion in the radial plane perpendicular to the axis of the connector is a good complement to the axial insertion distance tolerance of the constant impedance connector and provides 3-axis alignment tolerance.

FIG. 4 shows a second embodiment of the present invention. The base piece 10 of the design shown in FIG. 1 has been used, but the double ended piece has been modified and forms a right angle double ended piece 56. The right angle double ended piece 56 in FIG. 4 includes a subconnector end which is substantially identical to the subconnector end 28 shown in FIGS. 1–3. However the main connector end 58 is formed at right angle to the subconnector end. Either the double ended piece 56 of FIG. 4 or the double ended piece 12 of FIG. 1 may be connected to the base piece 10, depending upon whether a right angle or in-line main connector type of connection is desired.

To illustrate another of the many possible variations, the main connector in FIG. 4 is shown as a male plug-type main connector which can engage the female socket type main connector 26 in FIG. 1. A right angle female socket type main connector could also be constructed in an alternative variation. The main connector end 58 in FIG. 4 has also been illustrated as a constant impedance connector of the type shown in U.S. Pat. No. 4,917,630, however, other types of main connectors may be constructed on the double ended piece.

The inner conductor 22 on the base piece 10 in FIG. 1 is held in position by insulator 41. Insulator 41 may be any type of electrically insulating material that is resistant to heat and chemicals to which the base piece 10 may be exposed. Typically insulator 41 and all the other insulator pieces, such as insulator 43 and insulators 55, 57 in FIG. 4, will be a plastic material, such as tetrafluoroethylene (sold under the trade name Teflon). The inner conductor 22 of the base piece and the inner conductor pin 30 of the double ended piece are preferably made of beryllium-copper. Corresponding inner conductors in the embodiment of FIG. 4 are also made of beryllium-copper.

Figure 5:
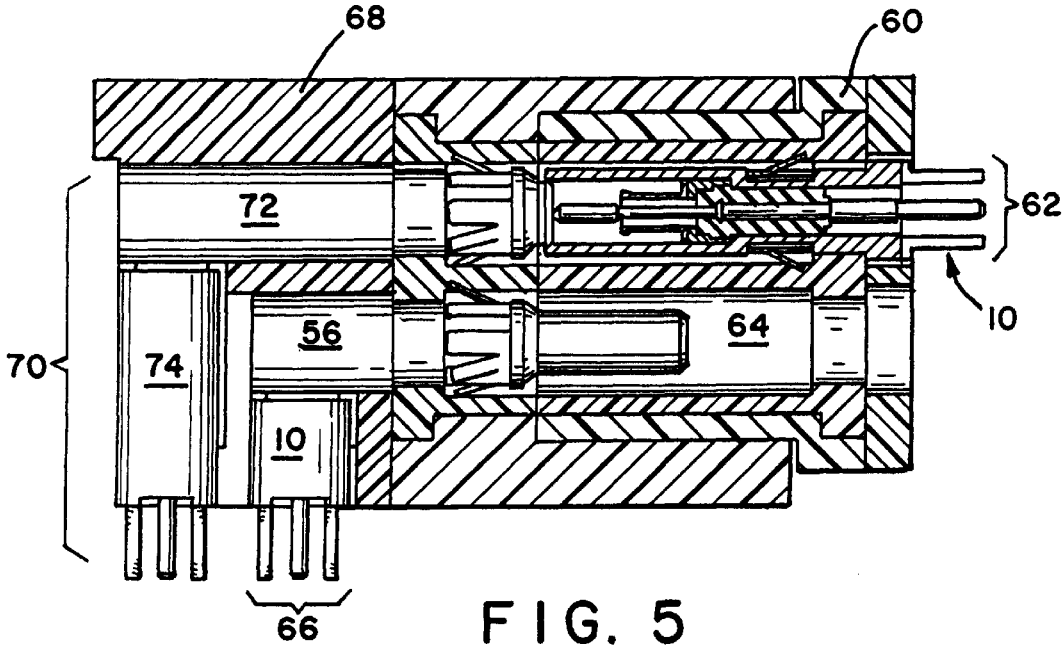
FIG. 5 is a partial cross-sectional view showing three embodiments of self aligning multi-part connectors according to the present invention. The three connectors are shown assembled into two mating housings, each housing having two openings designed to receive a connector of the present invention. The socket type connector of FIG. 1 is shown in cross section inserted into an in-line housing with the adjacent connector opening in the housing having its identical socket type connector omitted for clarity. The second housing is a right angle housing having a right angle plug type connector according to FIG. 4 and a modified right angle plug type connector similar to the right angle plug type connector of FIG. 4 wherein the base piece and the double ended piece have been lengthened. The right angle plug type connectors have not been shown in cross section.

FIG. 5 shows three different embodiments of self-aligning multipart connectors according to the present invention which have been assembled into two mating housings. Each housing includes two openings designed to receive corresponding connectors of the present invention. A male housing 60 is shown with a connector 62 that is identical to the connector seen in FIGS. 1–3. A second identical connector would normally be installed in opening 64 in housing 60 but has been omitted for clarity.

A right angle connector 66 is shown installed in one of the two openings in female housing 68. Connector 66 is identical to the connector seen in cross section in FIG. 4. The base pieces on connectors 62 and 66 are identical and correspond to base piece 10 in FIGS. 1–3. Connector 66 includes a double ended piece 56 which corresponds to the right angle double ended piece 56 in FIG. 4. Connector 70 includes a right angle double ended piece 72 and a base piece 74 which are similar to the adjacent base piece 10 and double ended piece 56 except that they have been lengthened to fit into the right angle housing 68.

In FIG. 4, the resilient member 54 is shown as having a flattened washer shape, instead of an O-ring shape, but it still provides the desired rocking action between the fixed base piece 10 and the double ended piece 56.

FIGS. 6 and 7 show mating in-line housings 80, 82. Housing 80 includes two connectors 84, 86 mounted with base pieces 10 to a printed circuit board 88. The base pieces 10 may be identical to the base piece 10 in FIGS. 1–3, or they may be designed specifically for the associated double ended piece. The double ended pieces of connectors 84 and 86 are very similar to the double ended pieces shown in FIGS. 1–3 except that the socket type female main connectors of FIGS. 1–3 have been replaced with plug type male connectors on the main connector ends of the connectors in housing 80.

The mating housing 82 includes two connectors 90, 92 that mate with the connectors 84 and 86 in housing 80. Connectors 90, 92 include double ended pieces which may be identical to the double ended piece 12 from FIGS. 1–3 and which mate with the main connector on the double ended pieces from connectors 84 and 86. The base pieces 94, 96 on connectors 90, 92, have been constructed with end launcher mounts on the mount end of the base pieces. The end launcher mounts can be soldered to the edge of multilayer printed circuit board 98. The printed circuit board 98 has been shown in phantom. The inner and outer conductors 100, 102 in the end launcher mounts have soldering points which are offset to correspond to the different layers 104, 106 of multi-layer circuit board 98.

It will be noted that the rocking action of the connectors in housing 82 complements the rocking action of the connectors in housing 80 in a way that avoids the necessity for radial floating as provided in prior art connectors. Specifically, prior art self-aligning connectors have heretofore been designed so that they allow the axis of the connector to move radially while still remaining parallel to the original axis. The present invention avoids this requirement and uses only angular rocking to meet the self-alignment requirement.

In the design of FIG. 6, the axis of each base piece of a connector in housing 82 is not necessarily aligned with the axis of the base piece of the corresponding connector in housing 80. Nonetheless, the double ended pieces in each housing rock as they are mated so that their angular orientation connects these base pieces. As a result, the present invention can accommodate radial misalignment, as well as angular misalignment, when the two connectors of this invention are mated, even though each connector provides only an angular rocking action. The prior art floating design wherein the connector must move radially from side to side without changing its angular orientation is not needed.

The design of the right angle connector in FIG. 5 also provides this capability. This radial alignment compensation is provided whenever an assembled connector of this invention is connected to another mating assembled connector constructed according to this invention and is achieved even though the connectors provide only an angular rocking action.

From the description given above it can be seen an important advantage of the present invention resides in the self-alignment capability of the connector resulting from the rocking action between the base piece and the double ended piece permitted by the resilient member 42. Thus, the present invention is highly desirable even when the base piece and the double ended piece are pre-assembled and the complete connector is soldered in its assembled condition to the circuit board. This is particularly the case where the advantages of a constant impedance connector (which allows the mating connector to be only partially seated axially) are combined with the present design which allows self-aligning motion perpendicular to the axis of the connector.

As a result, it is possible, or in some cases preferable, to construct the connector in its fully assembled condition and thereafter to install the assembled connector as a single piece. In this case, it may also be preferable to design unique base pieces that meet special requirements and which are different from other base pieces and not compatible with the double ended pieces of other similar connectors. Thus, the "mix and match" capability of some embodiments of this invention and the capability of separately installing the base piece from the double ended piece are not fundamental to all embodiments of the connector of this invention.

The method of this invention, however, is particularly advantageous when it is necessary to connect a processing sensitive type of main connector to a circuit board that will be subjected to processing conditions which the main connector is sensitive to. The method of this invention includes attaching a processing insensitive base piece to a connection point on an electrical circuit. The base piece includes a base piece as described having a mounting end and a subconnector end. The mounting end has a mount for connection to the connection point on the electrical circuit. The subconnector end has a base subconnector formed thereon.

The electrical circuit is then processed by soldering, cleaning or otherwise completing the steps of processing which the main connector is sensitive to. This rigidly connects the mount on the base piece to the connection point on the electrical circuit. The processing sensitive double ended connector piece is then connected to the subconnector end of the base piece. The double ended connector piece may include any desired type of main connector along with a subconnector that mates with the subconnector on the base piece.

The connectors may be used alone, or a housing may be connected after the base pieces have been soldered and the double ended pieces attached. The double ended pieces may be attached to the base pieces before they are soldered or they may be attached to the base pieces after they are soldered. The double ended pieces may be installed in the housing first and later connected to the base pieces, or they may be connected to the base pieces first and the housing added later.

The electrical connection points on electrical circuits may be pads for surface mount base pieces, openings in printed circuit boards such as are conventionally used for mounting components with leads, or edge pads that are used for attaching end launchers on the edge of a circuit board.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A multi-part electrical connector connectable to a corresponding electrical connector, the multi-part electrical connector comprising:

a base piece for connection to a connection point on an electrical circuit, the base piece including:

a mounting end having a mount formed thereon, the mount being rigidly mountable and connectable to the connection point on the electrical circuit, and a subconnector end having a base subconnector formed thereon; and a double ended connector piece including:

a subconnector end having a second subconnector formed thereon, the second subconnector being mateable to the base subconnector, and a main connector end having a main connector formed thereon, the main connector being mateable to the corresponding electrical connector; the second subconnector supporting the double ended connector piece on the base piece without additional support to form the multi-part electrical connector as an integrated connector and the second subconnector engaging the base subconnector sufficiently strongly to permit the corresponding electrical connector to be connected to and disconnected from the main connector end of the integrated multi-part electrical connector without disengaging the double ended connector piece from the base piece.

2. The multi-part electrical connector of claim 1 wherein the double ended connector piece is movable relative to the base piece to make the multi-part electrical connector self-aligning relative to the corresponding electrical connector.

3. The multi-part electrical connector of claim 1 further comprising a resilient member positioned between the base piece and the double ended connector piece.

4. The multi-part electrical connector of claim 3 wherein the resilient member is a ring.

5. The multi-part electrical connector of claim 4 wherein the resilient member is an O-ring.

6. The multi-part electrical connector of claim 1 further comprising a plurality of flanges for holding the multi-part electrical connector in a housing.

7. The multi-part electrical connector of claim 6 further comprising a housing, the plurality of flanges engaging the housing to hold the multi-part electrical connector therein.

8. The multi-part electrical connector of claim 1 wherein the double ended connector piece further includes a plurality of flanges for holding the multi-part electrical connector in a housing.

9. The multi-part electrical connector of claim 1 wherein the main connector on the double ended connector piece is formed at an angle to the subconnector on the double ended connector piece.

10. The multi-part electrical connector of claim 9 wherein the angle between the main connector and the subconnector is ninety degrees.

11. The multi-part electrical connector of claim 10 in combination with a housing and at least one additional multi-part electrical connector having a base piece and a double ended connector piece, the housing holding the multi-part electrical connectors in alignment for connection to corresponding electrical connectors.

12. The multi-part electrical connector of claim 1 in combination with a housing and at least one additional multi-part electrical connector having a base piece and a double ended connector piece, the housing holding the multi-part electrical connectors in alignment for connection to corresponding electrical connectors.

13. The multi-part electrical connector of claim 1 wherein the main connector on the main connector end is mateable to a constant impedance electrical connector.

14. The multi-part electrical connector of claim 1 wherein the base piece is sufficiently resistant to heat to permit the base piece to be soldered by wave soldering.

15. The multi-part electrical connector of claim 1 wherein the base piece is more resistant to damage from conventional circuit board processing steps than the double ended connector piece.

16. A multi-part electrical connector system comprising:

a base piece selected from among a plurality of different base pieces that correspond to different types of electrical connection points on electrical circuits, each different base piece including:

a mounting end having a mount formed thereon, the mount being rigidly mountable to the corresponding type of electrical connection point, and a subconnector end having a base subconnector formed thereon; and a double ended connector piece selected from among a plurality of different double ended connector pieces that correspond to different types of main electrical connectors, each different double ended connector piece including:

a subconnector end having a second subconnector formed thereon, the second subconnector on the double ended connector piece being mateable to the base subconnector on the base pieces, and a main connector end having a main connector formed thereon, the main connector being mateable to the corresponding type of main electrical connector; the second subconnector supporting the double ended connector piece on the base piece without additional support to form an integrated connector and the second subconnector engaging the base subconnector sufficiently strongly to permit the corresponding type of main electrical connector to be connected to and disconnected from the main connector without disengaging the double ended connector piece from the base piece.

17. The multi-part electrical connector system of claim 16 further including at least one housing.

18. A method of attaching a connector to an electrical connection point on an electrical circuit, the method comprising the steps of:

positioning a base piece adjacent to the connection point, the base piece including:

a mounting end having a mount formed thereon, and a subconnector end having a base subconnector formed thereon;

soldering the mount on the base piece to the connection point on the electrical circuit; and attaching a double ended connector piece to the subconnector end of the base piece after the base piece has been soldered to the connection point, the double ended connector piece including:

a subconnector end having a second subconnector formed thereon, the second subconnector being mated to the base subconnector, and a main connector end having a main connector formed thereon; the second subconnector supporting the double ended connector piece on the base piece without additional support to form an integrated connector and the second subconnector engaging the base subconnector sufficiently strongly to permit another connector to be connected to and disconnected from the main connector without disengaging the double ended connector piece from the base piece.

19. The method of claim 18 further including the step of attaching a housing to the connector after the double ended connector piece has been attached to the subconnector end of the base piece.

20. The method of claim 18 wherein the base piece is more resistant to damage from conventional circuit board processing steps than the double ended connector piece.

* * * * *